US008150290B2

(12) United States Patent
Demuren et al.

(10) Patent No.: US 8,150,290 B2
(45) Date of Patent: Apr. 3, 2012

(54) METHOD AND APPARATUS FOR SAVING POWER IN AN IMAGE PRODUCTION DEVICE

(75) Inventors: Michael A. Demuren, Rochester, NY (US); David Lee Everhart, Spencerport, NY (US); Linda P. Lafrance, Pittsford, NY (US); Franley H. Sanchez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 12/485,978

(22) Filed: Jun. 17, 2009

(65) Prior Publication Data

US 2010/0322660 A1 Dec. 23, 2010

(51) Int. Cl.
*G03G 15/20* (2006.01)

(52) U.S. Cl. ..... 399/70; 399/67; 399/69

(58) Field of Classification Search ..... 399/67, 399/69, 70

See application file for complete search history.

(56) References Cited

U.S. PATENT DOCUMENTS 4,627,714 A * 12/1986 Nozaki ..... 399/70
5,489,935 A * 2/1996 Dornier ..... 347/211
5,946,526 A * 8/1999 Kim ..... 399/70
2005/0175367 A1* 8/2005 Urabe ..... 399/69

FOREIGN PATENT DOCUMENTS

JP 08129331 A * 5/1996

* cited by examiner

*Primary Examiner* — David Gray
*Assistant Examiner* — G. M. Hyder
(74) *Attorney, Agent, or Firm* — Ronald E. Prass, Jr.; Prass LLP

(57) ABSTRACT

A method and apparatus for saving power in an image production device is disclosed. The method may include determining if the image production device has been inactive for a predetermined period of time, wherein if it is determined that the image production device has been inactive for a predetermined period of time, decreasing a fuser fan's output by a predetermined amount, decreasing a fuser lamp setting by a predetermined amount, the fuser system being heated to operate at a temperature that is at a first predetermined level, setting a timer, determining if the fuser system's temperature is at a second predetermined level, wherein if it is determined that the fuser system's temperature is not at the second predetermined level, determining if the timer expired, wherein if it is determined that the timer expired, decreasing a fuser lamp setting by the predetermined amount and resetting the timer.

21 Claims, 5 Drawing Sheets

METHOD AND APPARATUS FOR SAVING POWER IN AN IMAGE PRODUCTION DEVICE

BACKGROUND

Disclosed herein is a method for saving power in an image production device, as well as corresponding apparatus and computer-readable medium.

Conventional image production devices use power to maintain the fuser temperature in standby or other power modes in order to maintain First Paper Out Time (FPOT) requirements. In many cases, the power used to maintain this temperature is wasted. Independently, the system air flow and fuser lamp settings are chosen to maintain the system heat levels on other critical components within specification. The process in which the system airflow and fuser lamp settings are characterized and chosen is performed early during the development cycle of the product. During the project life cycle, or even during the use of the product at the customer's site, the airflow and fuser lamp values selected are not easily changed and in many cases not optimal when considering power consumption. Specifically, the higher the air flow and fuser lamp settings are in standby, the higher the power consumption of the fuser to maintain its chosen setpoint.

SUMMARY

A method and apparatus for saving power in an image production device is disclosed. The method may include determining if the image production device has been inactive for a predetermined period of time, wherein if it is determined that the image production device has been inactive for a predetermined period of time, decreasing a fuser fan's output by a predetermined amount, the fuser fan blowing air in the vicinity of a fuser system to cool the fuser system, decreasing a fuser lamp setting by a predetermined amount, the fuser lamp being capable of heating the fuser system to a desired temperature, the fuser system being heated to operate at a temperature that is at a first predetermined level, setting a timer, determining if the fuser system's temperature is at a second predetermined level, the second predetermined level being a lower temperature than the first predetermined level, wherein if it is determined that the fuser system's temperature is not at the second predetermined level, determining if the timer expired, wherein if it is determined that the timer expired, decreasing a fuser lamp setting by the predetermined amount and resetting the timer, wherein the steps of decreasing the fuser lamp setting by the predetermined amount, resetting the timer, and determining if the fuser system's temperature is at the second predetermined level, are performed until one of the fuser system's temperature reaches the second predetermined level, the image production device is determined to be active, and the image production device is powered off.

DETAILED DESCRIPTION

Figure 1:
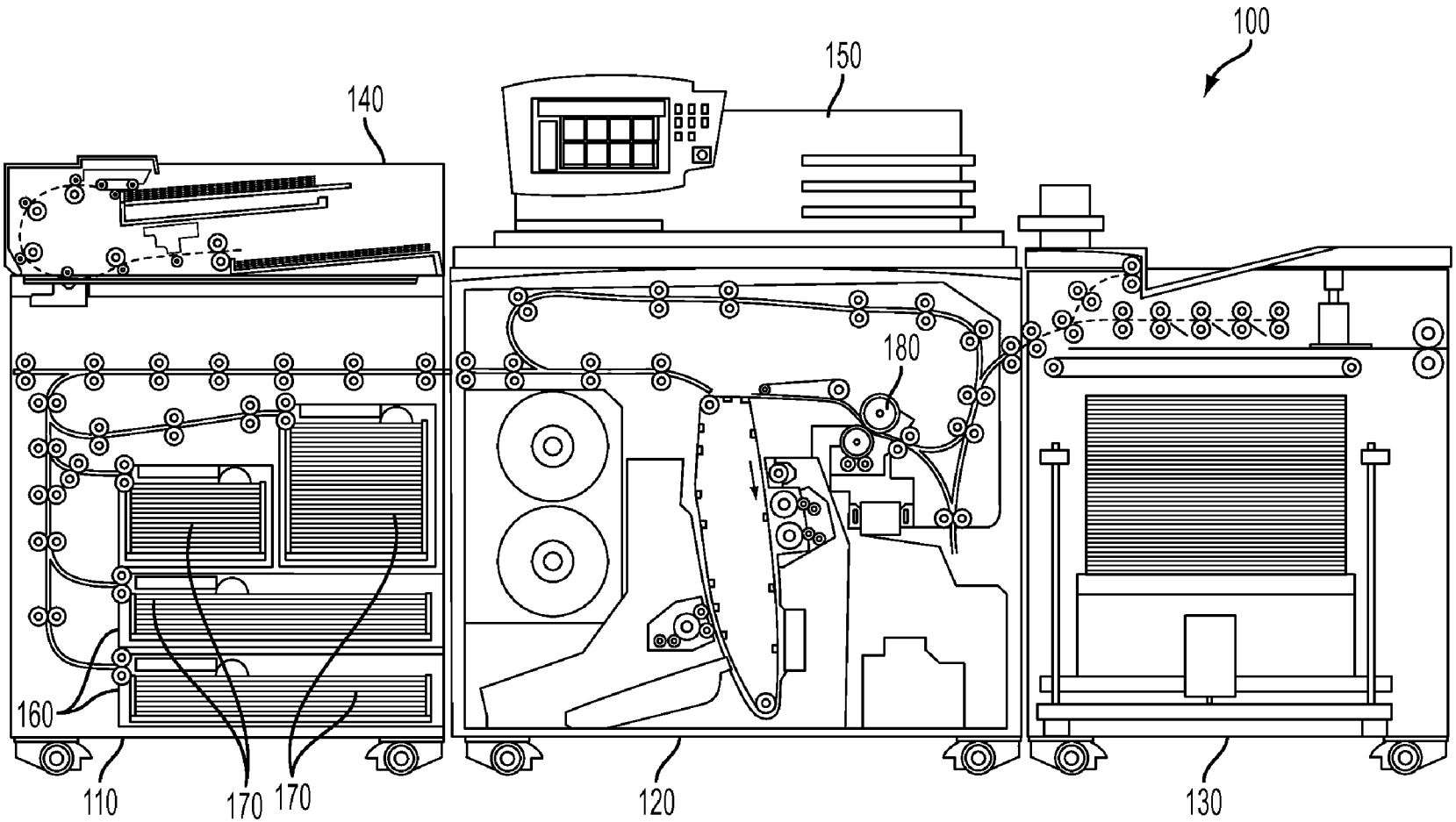
FIG. 1 is an exemplary diagram of an image production device in accordance with one possible embodiment of the disclosure.

Aspects of the embodiments disclosed herein relate to a method for saving power in an image production device, as well as corresponding apparatus and computer-readable medium.

The disclosed embodiments may include a method for saving power in an image production device. The method may include determining if the image production device has been inactive for a predetermined period of time, wherein if it is determined that the image production device has been inactive for a predetermined period of time, decreasing a fuser fan's output by a predetermined amount, the fuser fan blowing air in the vicinity of a fuser system to cool the fuser system, decreasing a fuser lamp setting by a predetermined amount, the fuser lamp being capable of heating the fuser system to a desired temperature, the fuser system being heated to operate at a temperature that is at a first predetermined level, setting a timer, determining if the fuser system's temperature is at a second predetermined level, the second predetermined level being a lower temperature than the first predetermined level, wherein if it is determined that the fuser system's temperature is not at the second predetermined level, determining if the timer expired, wherein if it is determined that the timer expired, decreasing a fuser lamp setting by the predetermined amount and resetting the timer, wherein the steps of decreasing the fuser lamp setting by the predetermined amount, resetting the timer, and determining if the fuser system's temperature is at the second predetermined level, are performed until one of the fuser system's temperature reaches the second predetermined level, the image production device is determined to be active, and the image production device is powered off.

The disclosed embodiments may further include an image production device that may include a memory that stores predetermined values relating to saving power, a fuser temperature sensor that senses the temperature of a fuser system, one or more timers, a fuser fan that blows air in the vicinity of a fuser system to cool the fuser system, a fuser lamp that is capable of heating the fuser system to a desired temperature, the fuser system being heated to operate at a temperature that is at a first predetermined level, and a power saving unit that determines if the image production device has been inactive for a predetermined period of time, wherein if the power saving unit determines that the image production device has been inactive for a predetermined period of time, the power saving unit decreases the fuser fan's output by a predetermined amount, decreases the fuser lamp setting by a predetermined amount, sets one of the one or more timers, determines if the fuser system's temperature is at a second predetermined level using the fuser temperature sensor, wherein if the power saving unit determines that the fuser system's temperature is not at the second predetermined level, the power saving unit determines if the set timer has expired, wherein if the power saving unit determines that the set timer has expired, the power saving unit decreases the fuser lamp setting by the predetermined amount and resets the timer, wherein the second predetermined level is lower temperature than the first predetermined level and the power saving unit decreases the fuser lamp setting by the predetermined amount, resets the timer, and determines if the fuser system's temperature is at the second predetermined level, until one of the fuser system's temperature reaches the second predetermined level, the image production device is active, and the image production device is powered off.

The disclosed embodiments may further include a computer-readable medium storing instructions for controlling a computing device for saving power in an image production device. The instructions may include determining if the image production device has been inactive for a predetermined period of time, wherein if it is determined that the image production device has been inactive for a predetermined period of time, decreasing a fuser fan's output by a predetermined amount, the fuser fan blowing air in the vicinity of a fuser system to cool the fuser system, decreasing a fuser lamp setting by a predetermined amount, the fuser lamp being capable of heating the fuser system to a desired temperature, the fuser system being heated to operate at a temperature that is at a first predetermined level, setting a timer, determining if the fuser system's temperature is at a second predetermined level, the second predetermined level being a lower temperature than the first predetermined level, wherein if it is determined that the fuser system's temperature is not at the second predetermined level, determining if the timer expired, wherein if it is determined that the timer expired, decreasing a fuser lamp setting by the predetermined amount and resetting the timer, wherein the steps of decreasing the fuser lamp setting by the predetermined amount, resetting the timer, and determining if the fuser system's temperature is at the second predetermined level, are performed until one of the fuser system's temperature reaches the second predetermined level, the image production device is determined to be active, and the image production device is powered off.

The disclosed embodiments may concern a method and apparatus for saving power in an image production device. The process may concern adding an image production device feature to select total air flow levels and fuser lamp settings as a function of the fuser power usage in standby, thus creating a new power saver standby mode. The process may also include switching between an active standby mode and a power saving standby mode. The active standby mode is the convectional standby behavior in image production devices. The power saving standby mode discussed herein may be the new proposed additional standby behavior in image production devices. If the process detects the presence of a user through mouse activation or other behavior, the process may switch to run ready or operating mode.

The active standby mode is the conventional behavior in image production devices. The system using this process maintains a run mode temperature of 180° C., a standby mode temperature of 185° C., and a low power mode temperature of 140° C. The main print engine cavity fan is set at 100% duty cycle in run mode and it is set at 30% duty cycle in stand by mode. These air flow and fuser lamp settings may not be altered by the process described in the disclosed embodiments.

In the power saving standby mode of the disclosed embodiments, the system's fuser cavity cooling fan (or "fuser fan") may be reduced to a standby setting and the standby fuser lamp temperature settings may be gradually reduced as time passes with no mouse or keyboard activation until the temperature reaches the set temperature for low power mode.

Figure 5:
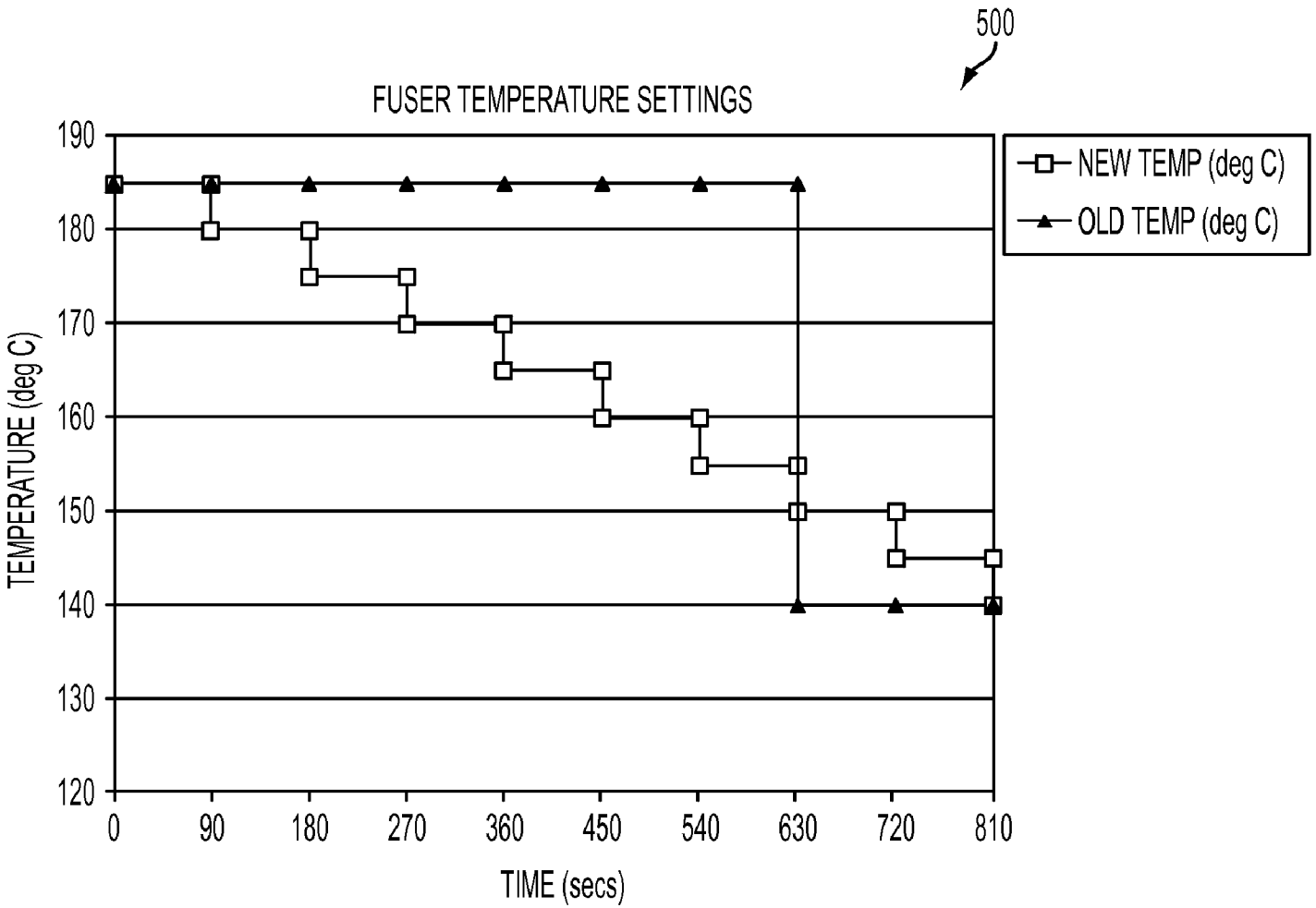
FIG. 5 is an exemplary graph illustrating the power saving data in accordance with one possible embodiment of the disclosure.

After a job or machine activity, the system may maintain the operating temperature of 185° C. for a predetermined amount of time, such as 90 seconds, for example. If no mouse activity is present during this time, the temperature may be reduced by a predetermined amount, such as 5° C. to 180° C., for example. After another 90 seconds of no activity, the temperature may be further reduced by another 5° C. to 175° C., for example. This steady ramp down of the temperature may continue for a predetermined number of iterations until the fuser temperature reaches 140° C. or the low power mode temperature of 140° C., for example. The power to be saved may be described by the area between the Old Temp line and the New Temp line in the FIG. 5, for example.

With the default low power mode set to 10 minutes as in the conventional standby mode process, if there is no mouse activity, the system may go through 6 iterations, or approximately 9 minutes, before having to enter low power mode. In the process described in the disclosed embodiments, a predetermined standby temperature, such as 155° C., may be maintained for 1 minute before being reduced further to the set low power mode temperature, such as 140° C. In the case that the predetermined default time is changed, the number of power saving iterations may be different. For example, if the time to enter low power mode is changed to 15 minutes, with no mouse activity, the system may go through 9 iterations of this power saving temperature reduction resulting in maintaining 140° C. after 13.5 minutes.

At any point in this mode, if mouse/keyboard/USB/network activity is present, the system may immediately respond to maintain the predetermined active standby mode temperature, such as 185° C. If the user intends to print, by the time the job is sent and processed, the system may be at run ready or operating temperature. As a result, delay due to the fuser warming up may be avoided and there may be little to no effect on the First Paper Out Time (FPOT) requirements.

The above power saving standby set points may be controllable by an image production device processor and memory, for example. By enabling this feature, the time and temperature reductions may be modified as needed. The fuser lamp control process takes into account the temperature setpoint desired. If the next temperature reading indicates that the temperature is below the setpoint, the controls may turn the fuser lamp on until temperature is achieved. The new standby feature described in the disclosed embodiments may extend the time needed to turn on the fuser lamp as much as possible and still maintain FPOT requirements. What is significant is the number of times the fuser is turned on to maintain temperature. To maintain the same setpoint, the conventional process may require the system to turn the fuser lamp twice as much as in using the disclosed standby process (this value is only for illustration purposes).

By combining the two operating features of the fuser lamp and fuser fan settings, the goal to reduce power consumption by addressing the standby behavior of the equipment was achieved without compromising the system's performance. Some of the benefits of the disclosed power saving standby process may be:

- Reduces carbon footprint of the print engine.
- Reduces customer's operating cost in terms of energy usage above and beyond Energy Star compliance.
- Extends fuser component life.
- Reduces power to meet Energy Star levels.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application of air pressure toward the top sheet or sheets in a media stack 170. The fluffer may blow air onto the edge of a media stack 170 to create separation between the media sheets in order to avoid jamming of the image production device 100. Certain types of coated media are advantageously drawn from a media stack 170 by the use of an application of heat, such as by a stream of hot air blown on the media stack 170 using the fluffer, for example.

Once fluffed, the sheets of media drawn from a media stack 170 on a selected tray 160 may then be moved to the fuser system 180 located in the image production section 120 to receive one or more images thereon. Heat and pressure from the fuser system 180 may cause the toner image to become substantially permanent on the sheet. Then, the printed sheet is then moved to output section 130, where it may be collated, stapled, folded, etc., with other media sheets in manners familiar in the art.

Figure 2:
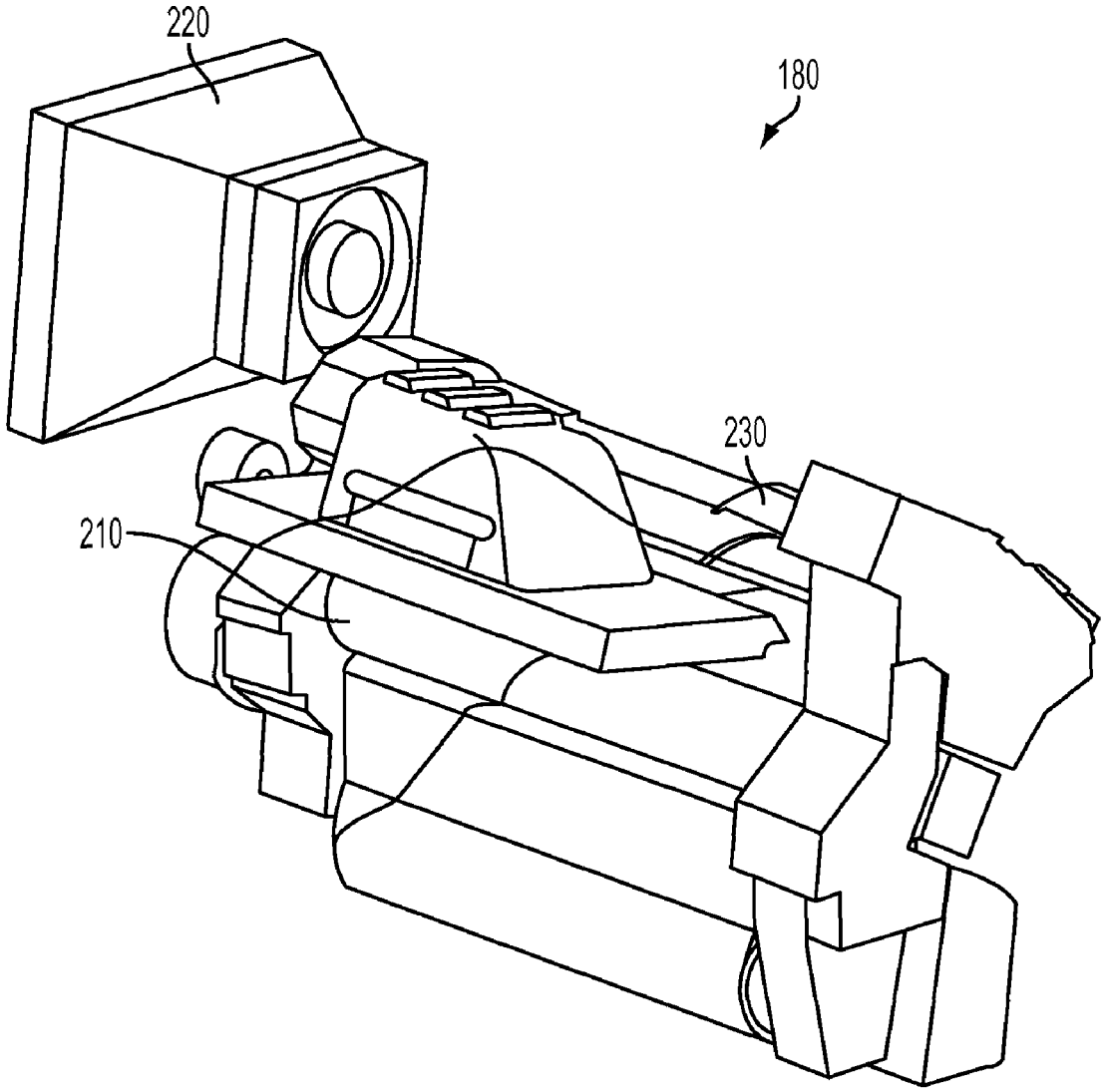
FIG. 2 is a diagram of a fuser system in the image production device in accordance with one possible embodiment of the disclosure.

FIG. 2 is a diagram of a fuser system 180 in the image production device 100 in accordance with one possible embodiment of the disclosure. The fuser system 180 is located in the image production section 120 may include a fuser lamp 210, a fuser fan 220, and one or more fuser temperature sensors 230.

The fuser lamp 210 may represent any fuser lamp or heating device that may heat the fuser system 180 to a desired operating temperature so that desired images may be properly transferred to media sheets. The desired operating temperature may be 185° C. for example. However, the fuser lamp 210 may also serve heat the fuser system 180 at temperatures below the operating temperature for the purposes of the standby modes discussed herein with respect to the disclosed embodiments. The fuser fan 220 may represent any fan or cooling device that may serve to cool the fuser system 180 by blowing air in its vicinity so that the system does not overheat and may also reach a desired standby temperature when inactivity is sensed. The one or more fuser temperature sensors 230 may be any temperature sensors known to one of skill in the art that may provide temperature information concerning the fuser system 180 to a temperature or power controlling device, such as a power saving unit, as discussed further below.

Figure 3:
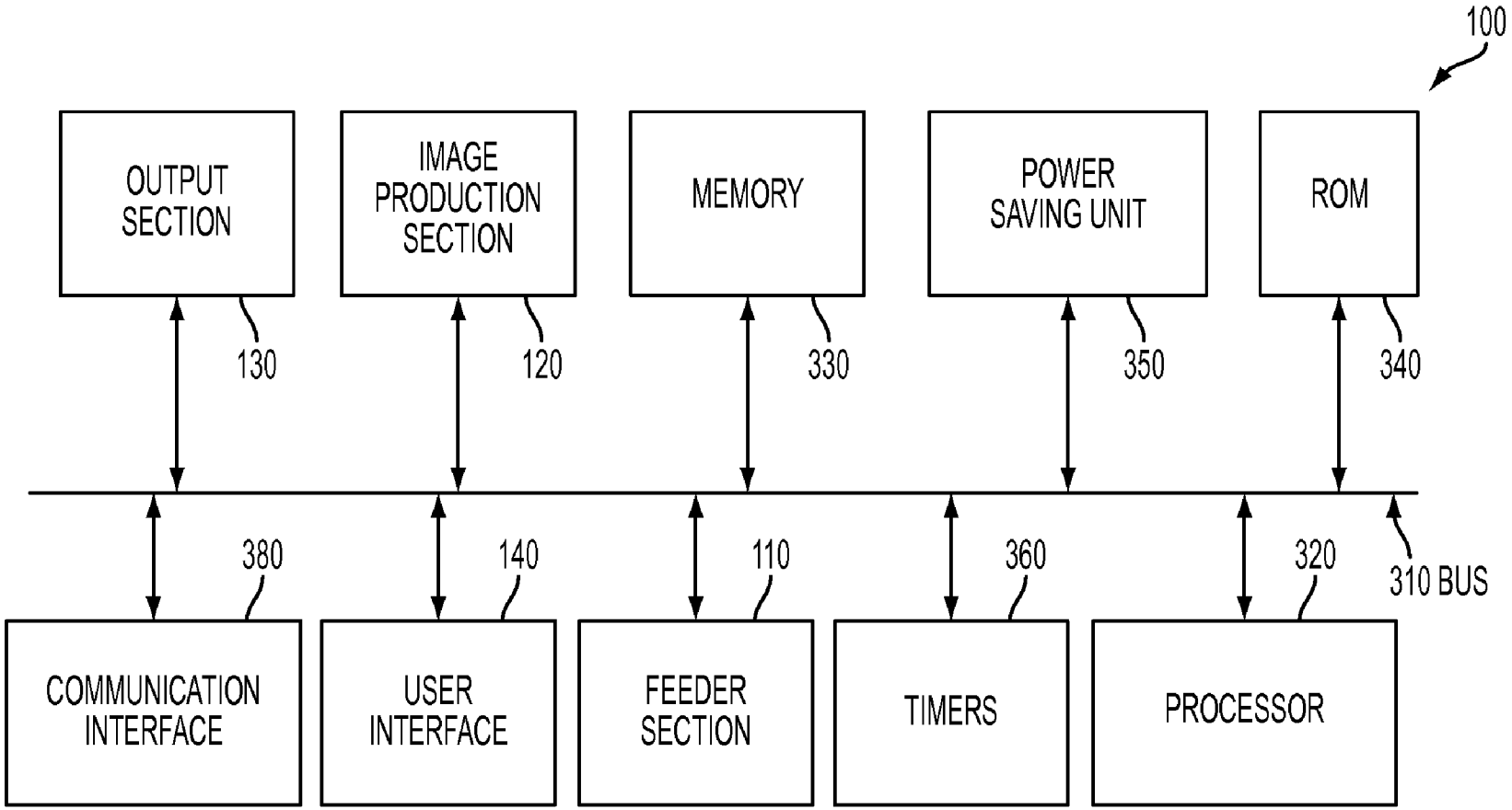
FIG. 3 is an exemplary block diagram of the image production device in accordance with one possible embodiment of the disclosure.

FIG. 3 is an exemplary block diagram of the image production device 100 in accordance with one possible embodiment of the disclosure. The image production device 100 may include a bus 310, a processor 320, a memory 330, a read only memory (ROM) 340, a power saving unit 350, a feeder section 110, an output section 130, a user interface 150, one or more timers 360, a communication interface 380, and an image production section 120. Bus 310 may permit communication among the components of the image production device 100.

Processor 320 may include at least one conventional processor or microprocessor that interprets and executes instructions. Memory 330 may be a random access memory (RAM) or another type of dynamic storage device that stores information and instructions for execution by processor 320. Memory 330 may also include a read-only memory (ROM) which may include a conventional ROM device or another type of static storage device that stores static information and instructions for processor 320.

Communication interface 380 may include any mechanism that facilitates communication via a network. For example, communication interface 380 may include a modem. Alternatively, communication interface 380 may include other mechanisms for assisting in communications with other devices and/or systems. The one or more timers 360 may represent any software or hardware timers that may be set at a predetermined value and decremented, or may be set to zero (or another value) and incremented until it reaches a predetermined value, for example.

ROM 340 may include a conventional ROM device or another type of static storage device that stores static information and instructions for processor 320. A storage device may augment the ROM and may include any type of storage media, such as, for example, magnetic or optical recording media and its corresponding drive.

As stated above, user interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, a spreader, etc., for example.

The image production device 100 may perform such functions in response to processor 320 by executing sequences of instructions contained in a computer-readable medium, such as, for example, memory 330. Such instructions may be read into memory 330 from another computer-readable medium, such as a storage device or from a separate device via communication interface 380.

The image production device 100 illustrated in FIGS. 1-3 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the power saving unit 350 and power saving process will be discussed in relation to the block diagram in FIGS. 1-3 and the flowchart in FIG. 4.

Figure 4:
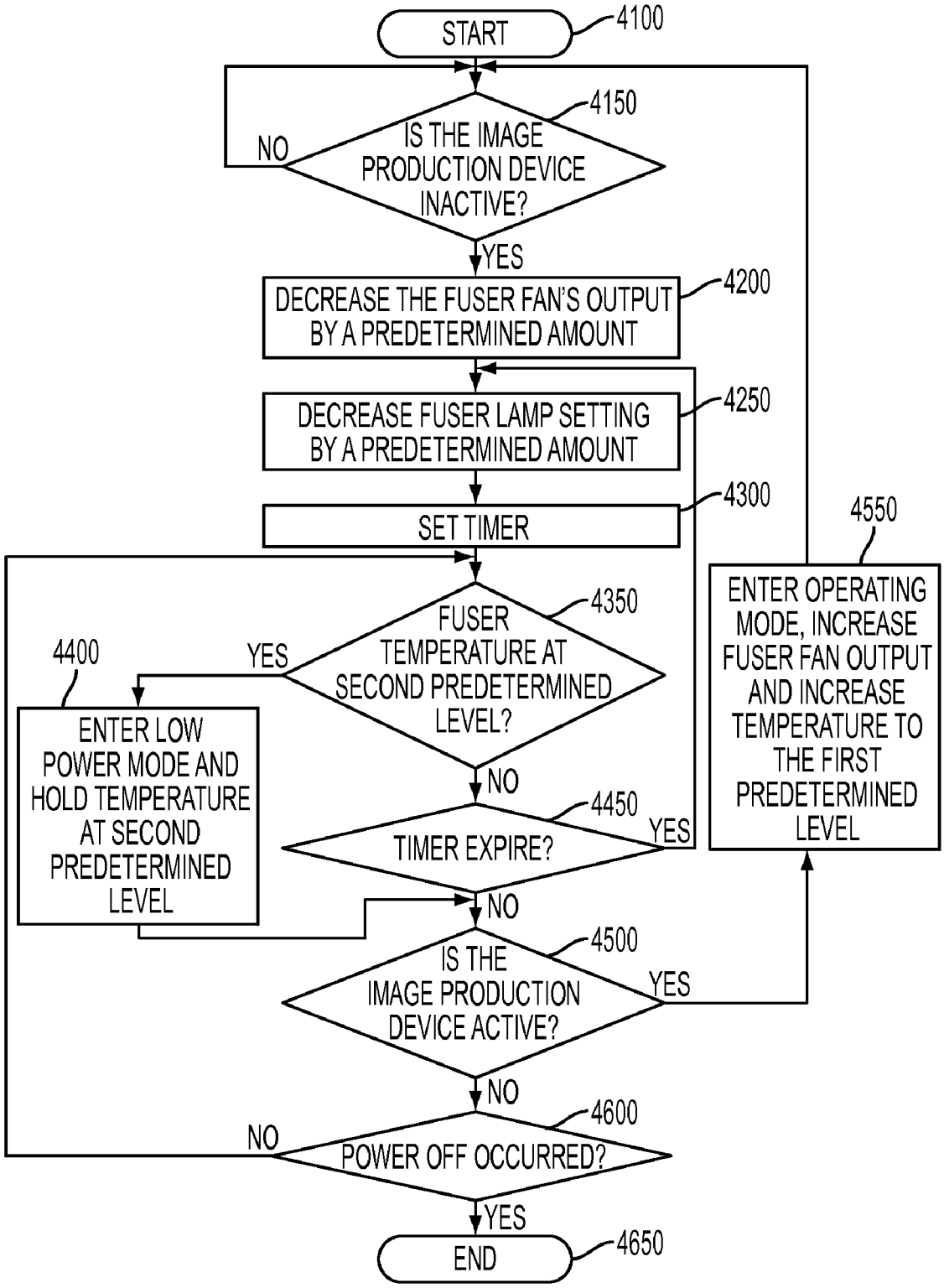
FIG. 4 is a flowchart of an exemplary power saving process in accordance with one possible embodiment of the disclosure.

FIG. 4 is a flowchart of a possible power saving process in accordance with one possible embodiment of the disclosure. The process may begin at step 4100, and continues to step 4150 where the power saving unit 350 may determine if the image production device 100 has been inactive for a predetermined period of time. The predetermined period of time of inactivity may be any reasonable value (e.g., 1-15 minutes) and may be stored in memory 330. The value may be set at the factory or may varied by the settings entered by the user at the user interface 150, for example. If the power saving unit 350 determines that the image production device 100 has not been inactive for the predetermined period of time, the power saving unit 350 may return to step 4100.

If at step 4150 the power saving unit 350 determines that the image production device 100 has been inactive for the predetermined period of time, at step 4200, the power saving unit 350 may decrease the fuser fan's 220 output by a predetermined amount. The predetermined amount may be any amount that will permit the power saving process of the disclosed embodiments and not permit the fuser system 180 from overheating (e.g., reduced anywhere from 25%-75%). At step 4250, the power saving unit 350 may decrease the fuser lamp 210 setting by a predetermined amount. In an operating mode, the fuser system 180 may be heated to operate at a first predetermined level and may represent any operating temperature of an image production device 100, such as approximately 180° C.-190° C., for example. The predetermined amount of decrease may be any amount, such as approximately 5° C.-10° C., for example. At step 4300, the power saving unit 350 may set one of the one or more timer 360. The timer 360 may be set at a predetermined value and decremented, or the timer 360 may be set to zero (or another value) and incremented until it reaches a predetermined value, for example.

At step 4350, the power saving unit 350 may determine if the fuser system's 180 temperature is at a second predetermined level. Note that the second predetermined level may be a lower temperature than the first predetermined level and may represent any standby temperature of an image production device 100, such as approximately 135° C.-145° C., for example. If the power saving unit 350 determines that the fuser system's 180 temperature is at the second predetermined level, at step 4400, the power saving unit 350 may enter the image production device 100 in a low power mode and hold the fuser system's 180 temperature at the second predetermined level. The process then goes to step 4500.

If at step 4350 the power saving unit 350 determines that the fuser system's 180 temperature is not at the second predetermined level, at step 4450, the power saving unit 350 may determine if the set timer 360 has expired. If the power saving unit 350 determines that the set timer 360 has expired, the process returns to step 4250 where the power saving unit 350 may decrease the fuser lamp 210 setting by a predetermined amount and reset one of the timers at step 4300.

If at step 4450, the power saving unit 350 determines that the set timer 360 has not expired, at step 4500 the power saving unit 350 may determine if the image production device 100 is active. The power saving unit 350 may determine if the image production device is active by the use of at least one of a user interface 150, a button, a mouse, a touch screen, a stylus, a door, and a cover. If the power saving unit 350 determines that the if the image production device 100 is active, at step 4550 the power saving unit 350 may enter the image production device 100 in an operating mode, increases the fuser fan 220 output, and increases the fuser lamp 210 settings to increase the fuser's system's 180 temperature to the first predetermined level.

If at step 4550, the power saving unit 350 determines that the if the image production device 100 is not active, at step 4600 the power saving unit 350 may determine if a power off of the image production device 100 occurred. If the power saving unit 350 determines that a power off of the image production device 100 did not occur, the process returns to step 4350. If at step 4600 the power saving unit 350 determines that a power off of the image production device 100 did occur, the process may go to step 4650 and end.

Note that the power saving unit 350 may continue to decrease the fuser lamp 210 setting by the predetermined amount, reset the timer 360, and determine if the fuser system's 180 temperature is at second predetermined level, until either the fuser system's 180 temperature reaches the second predetermined level, the image production device 100 is active, or the image production device 100 is powered off, for example.

The memory 330 may store predetermined values relating to saving power, such as fuser lamp settings including the predetermined amount of fuser system 180 temperature decrease, the first and second predetermined fuser system 180 temperature levels, the timer 360 settings, and any related fuser lamp 210 and fuser fan 220 settings or table of settings that may enable the fuser system 180 to reach the desired temperature levels to achieve the power saving process according to the disclosed embodiments.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for saving power in an image production device, comprising:

determining if the image production device has been inactive for a predetermined period of time, wherein if it is determined that the image production device has been inactive for a predetermined period of time, decreasing a fuser fan's output by a predetermined amount, the fuser fan blowing air in the vicinity of a fuser system to cool the fuser system;

decreasing a fuser lamp setting by a predetermined amount, the fuser lamp being capable of heating the fuser system to a desired temperature, the fuser system being heated to operate at a temperature that is at a first predetermined level;

setting a timer;

determining if the fuser system's temperature is at a second predetermined level, the second predetermined level being a lower temperature than the first predetermined level, wherein if it is determined that the fuser system's temperature is not at the second predetermined level, determining if the timer expired, wherein if it is determined that the timer expired, decreasing a fuser lamp setting by the predetermined amount and resetting the timer, wherein the steps of decreasing the fuser lamp setting by the predetermined amount, resetting the timer, and determining if the fuser system's temperature is at the second predetermined level, are performed until one of the fuser system's temperature reaches the second predetermined level, the image production device is determined to be active, and the image production device is powered off.

2. The method of claim 1, wherein the fuser system's temperature is determined to be at the second predetermined level, entering a low power mode; and holding the fuser system's temperature at the second predetermined level.

3. The method of claim 1, further comprising:

determining if the image production device is active, wherein if it is determined that the image production is active, entering an operating mode;

increasing the fuser fan output; and increasing the fuser lamp settings to increase the fuser's system's temperature to the first predetermined level.

4. The method of claim 3, wherein the image production device is determined to be active by the use of at least one of a user interface, a button, a mouse, a touch screen, a stylus, a door, and a cover.

5. The method of claim 1, wherein the first predetermined level is approximately 180° C.-190° C., the second predetermined level is approximately 135° C.-145° C., and the predetermined amount of decrease in the fuser lamp setting is approximately 5° C.-10° C.

6. The method of claim 1, wherein the timer is one of incremented and decremented.

7. The method of claim 1, wherein the image production device is one of a copier, a printer, a facsimile device, and a multi-function device.

8. An image production device, comprising:

a memory that stores predetermined values relating to saving power;

a fuser temperature sensor that senses the temperature of a fuser system;

one or more timers;

a fuser fan that blows air in the vicinity of a fuser system to cool the fuser system; a fuser lamp that is capable of heating the fuser system to a desired temperature, the fuser system being heated to operate at a temperature that is at a first predetermined level; and a power saving unit that determines if the image production device has been inactive for a predetermined period of time, wherein if the power saving unit determines that the image production device has been inactive for a predetermined period of time, the power saving unit decreases the fuser fan's output by a predetermined amount, decreases the fuser lamp setting by a predetermined amount, sets one of the one or more timers, determines if the fuser system's temperature is at a second predetermined level using the fuser temperature sensor, wherein if the power saving unit determines that the fuser system's temperature is not at the second predetermined level, the power saving unit determines if the set timer has expired, wherein if the power saving unit determines that the set timer has expired, the power saving unit decreases the fuser lamp setting by the predetermined amount and resets the timer, wherein the second predetermined level is lower temperature than the first predetermined level and the power saving unit decreases the fuser lamp setting by the predetermined amount, resets the timer, and determines if the fuser system's temperature is at the second predetermined level, until one of the fuser system's temperature reaches the second predetermined level, the image production device is active, and the image production device is powered off.

9. The image production device of claim 8, wherein if the power saving unit determines the fuser system's temperature to be at the second predetermined level, the power saving unit enters the image production device in a low power mode and holds the fuser system's temperature at the second predetermined level.

10. The image production device of claim 8, wherein if the power saving unit determines that the image production is active, the power saving unit enters the image production device in an operating mode, increases the fuser fan output, and increases the fuser lamp settings to increase the fuser's system's temperature to the first predetermined level.

11. The image production device of claim 10, wherein the power saving unit determines the image production device to be active by the use of at least one of a user interface, a button, a mouse, a touch screen, a stylus, a door, and a cover.

12. The image production device of claim 8, wherein the first predetermined level is approximately 180° C.-190° C., the second predetermined level is approximately 135° C.-145° C., and the predetermined amount of decrease in the fuser lamp setting is approximately 5° C.-10° C.

13. The image production device of claim 8, wherein the timer is one of incremented and decremented.

14. The image production device of claim 8, wherein the image production device is one of a copier, a printer, a facsimile device, and a multi-function device.

15. A non-transitory computer-readable medium storing instructions for controlling a computing device for saving power in an image production device, the instructions comprising:

determining if the image production device has been inactive for a predetermined period of time, wherein if it is determined that the image production device has been inactive for a predetermined period of time, decreasing a fuser fan's output by a predetermined amount, the fuser fan blowing air in the vicinity of a fuser system to cool the fuser system;

decreasing a fuser lamp setting by a predetermined amount, the fuser lamp being capable of heating the fuser system to a desired temperature, the fuser system being heated to operate at a temperature that is at a first predetermined level;

setting a timer;

determining if the fuser system's temperature is at a second predetermined level, the second predetermined level being a lower temperature than the first predetermined level, wherein if it is determined that the fuser system's temperature is not at the second predetermined level, determining if the timer expired, wherein if it is determined that the timer expired, decreasing a fuser lamp setting by the predetermined amount and resetting the timer, wherein the steps of decreasing the fuser lamp setting by the predetermined amount, resetting the timer, and determining if the fuser system's temperature is at the second predetermined level, are performed until one of the fuser system's temperature reaches the second predetermined level, the image production device is active, and the image production device is powered off.

16. The non-transitory computer-readable medium of claim 15, wherein the fuser system's temperature is determined to be at the second predetermined level, entering a low power mode; and holding the fuser system's temperature at the second predetermined level.

17. The non-transitory computer-readable medium of claim 15, further comprising:

determining if the image production device is active, wherein if it is determined that the image production is active, entering an operating mode;

increasing the fuser fan output; and increasing the fuser lamp settings to increase the fuser's system's temperature to the first predetermined level.

18. The non-transitory computer-readable medium of claim 17, wherein the image production device is determined to be active by the use of at least one of a user interface, a button, a mouse, a touch screen, a stylus, a door, and a cover.

19. The non-transitory computer-readable medium of claim 15, wherein the first predetermined level is approximately 180° C.-190° C., the second predetermined level is approximately 135° C.-145° C., and the predetermined amount of decrease in the fuser lamp setting is approximately 5° C.-10° C.

20. The non-transitory computer-readable medium of claim 15, wherein the timer is one of incremented and decremented.

21. The non-transitory computer-readable medium of claim 15, wherein the image production device is one of a copier, a printer, a facsimile device, and a multi-function device.

* * * * *